United States Patent [19]

Richardson

[11] Patent Number: 4,474,325

[45] Date of Patent: Oct. 2, 1984

[54] CONTROL CIRCUIT FOR HEATING SYSTEM

[76] Inventor: William M. Richardson, 120 Seventh St. East, Mobridge, S. Dak. 57601

[21] Appl. No.: 251,290

[22] Filed: Apr. 6, 1981

[51] Int. Cl.[3] ..... F24D 3/00

[52] U.S. Cl. ..... 237/8 R; 236/9 A; 165/40

[58] Field of Search ..... 237/8 R; 122/20 B, 447; 165/DIG. 2, 40; 236/9 A

[56] References Cited

U.S. PATENT DOCUMENTS

| | | | |
|---|---|---|---|
| 2,198,711 | 4/1940 | Turner | 122/447 |
| 4,111,357 | 9/1978 | Mieczkowski | 165/DIG. 2 |
| 4,147,301 | 4/1979 | Halma et al. | 237/8 R |
| 4,150,788 | 4/1979 | Matsumoto et al. | 237/8 R |

*Primary Examiner*—Albert J. Makay
*Assistant Examiner*—Henry Bennett
*Attorney, Agent, or Firm*—Larson and Taylor

[57] ABSTRACT

A control circuit for a heating system having a gas burner assembly, a heat absorbing coil, a heat releasing coil, a circulating pump for pumping a hydronic fluid between the two coils, and an air blower for the heat releasing coil is disclosed. The control circuit includes a thermostat located in the space to be heated and a first relay switch which electrically connects the circulating pump in response to a signal from the thermostat. A combustion safety control is electrically connected to the thermostat, a main gas valve, and a flame sensor such that the main gas valve is open in response to a signal from the thermostat and the main gas valve is closed where no signal is received from the thermostat or an insufficient signal is received from the flame sensor. A second relay switch is electrically connected to the air blower, the circulating pump, and a hydronic fluid temperature sensor such that in response to a signal from the fluid temperature sensor the air blower and the circulating pump are electrically connected. After the thermostat ceases to send a signal to the first relay switch, the second relay switch acts to electrically connect the air blower and the circulating pump so long as the temperature of the fluid is sufficient to provide heat to the space to be heated. A number of safety features are also provided.

10 Claims, 1 Drawing Figure

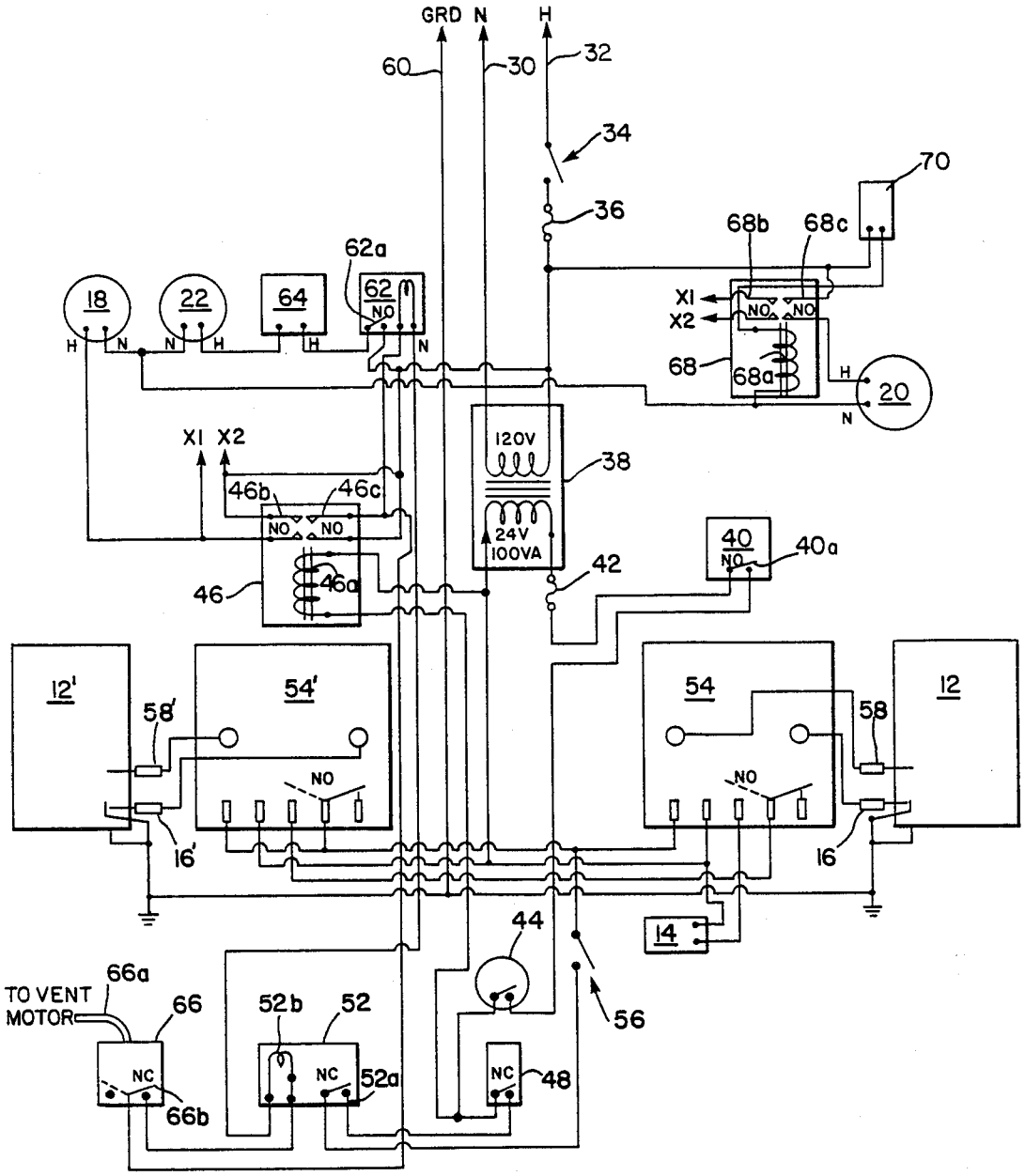
GRD
N
H
60
30
32
34
36
70
68b
68c
62a
62
NO
18
22
64
H
N
X1
X2
68
68a
20
120V
38
24V
100VA
46b
46c
46
46a
40
40a
42
12'
54'
58'
16'
54
12
58
16
14
44
56
66a
TO VENT
MOTOR
66
66b
NC
52b
52
52a
48

CONTROL CIRCUIT FOR HEATING SYSTEM

FIELD OF THE INVENTION

This invention relates to a control circuit for a heating system having a gas burner assembly.

BACKGROUND OF THE INVENTION

In U.S. Pat. No. 4,147,301 to Halma et al, a heating system including heat absorbing coils located adjacent a gas burner assembly and a heat releasing coil located in a space to be heated is disclosed. It has been found that this heating system is unexpectedly efficient. The present invention is a control circuit which is designed to operate a heating system such as that disclosed in the above-identified patent.

SUMMARY OF THE INVENTION

In accordance with the present invention, a control circuit for a heating system such as that disclosed in U.S. Pat. No. 4,147,301 to Halma et al, is provided. Such a heating system has a compartment in which a gas burner assembly and a heat absorbing coil are disposed, the burner assembly including an ignitor and a main gas valve. The heating system also has a heat releasing coil disposed in an enclosure to be heated, a circulating pump for pumping a hydronic fluid between the two coils, and an air blower for blowing air over the heat releasing coil and into the space to be heated. The control circuit for the heating system includes a thermostat located in the space to be heated and a first switch means. In response to a signal from the thermostat, the first switch means energizes the circulating pump means. A flame sensor is located in the gas burner for providing a signal in response to the presence of a flame. A combustion safety control unit is electrically connected to the thermostat, the main gas valve and the flame sensor. The combustion safety control unit supplies a signal to open the main gas valve in response to a signal from the thermostat, and also supplies a signal to close the main gas valve when an insufficient signal is received from the flame sensor or no signal is received from the thermostat. Also included in the control circuit is a hydronic fluid temperature sensor which supplies an electrical signal in response to the exceeding of a minimum temperature of the hydronic fluid. A second switch means is electrically connected to the air blower and the circulating pump such that, in response to a signal from the fluid temperature sensor, the air blower and the circulating pump are operated. In this manner, the air blower and the circulating pump operate after the signal from the thermostat ceases, so long as the signal from the fluid temperature sensor indicates that there is heat to be recovered from the hydronic fluid.

According to a preferred embodiment, a burner temperature limit control unit and a pressure safety control unit are electrically connected in series with the thermostat. Where the heating system also has a burner vent blower, the first switch means also electrically connects the burner vent blower in response to a signal from the thermostat. In order to allow time for the gas burner assembly to ignite properly, a first time delay switching device such as a time delay relay is provided which is electrically connected in series with the burner vent blower for delaying the activation of the burner vent blower for a short time period. An adjustable speed control unit for the burner vent blower is also provided so that correct combustion is obtained in the gas burner assembly. In order to assure that the burner vent blower is functioning properly, a burner vent air switch is electrically connected to the first switch means. A second time delay switching device receives the signal from the first air switch in response to the absence of an air flow and electrically disconnects the combustion safety control unit after a time period which is slightly longer than the time period of the first time delay switching device. Where a plurality of gas burner assemblies are provided in the heating system, a plurality of combustion safety control units and flame sensors are also provided for each gas burner assembly. A test switch, which is electrically connected to the combustion safety control units, is also provided so that servicing can be performed on the gas burner assemblies.

Other features and advantages of the present invention are stated in or are apparent from the detailed description of a presently preferred embodiment of the invention found hereinbelow.

BRIEF DESCRIPTION OF THE DRAWING

The single FIGURE is a schematic diagram of an electrical circuit in accordance with the present invention.

DETAILED DESCRIPTION OF THE PREFERRED EMBODIMENT

Referring to the drawing, a presently preferred embodiment of the control circuit of the present invention is depicted. As noted above, the control circuit of the invention is particularly adapted for use with a heating system such as the heating system disclosed in U.S. Pat. No. 4,147,301 to Halma et al, the contents of which patent is hereby incorporated by reference. In such a heating system, two gas burner assemblies 12 and 12' are located in a compartment adjacent one or more heat absorbing coils. A suitable gas burner assembly is a 16,000 BTU infra-red gas burner, Detroit model P16T. Each gas burner assembly 12 and 12' is fluidly connected to a main gas valve 14, such as a Dayton Number 2E228 gas valve, which automatically shuts off during a power failure. A pair of ignitors 16 and 16', such as a Honeywell No. Q330F spark ignitor, are individually provided for the respective gas burner assemblies 12 and 12'. A heat releasing coil is provided in an enclosure in the space to be heated. A circulating pump means 18, such as Grundfos type UPS 20-42, is used to pump a hydronic fluid from the heat absorbing coils to the heat releasing coils and back again. While distilled water can be used as the hydronic fluid, it is preferred that "Dow-Frost" liquid heat transfer agent or a similar liquid be used. An air blower 20, such as Dayton Model No. 3M393A, is provided adjacent the heat releasing coil to force air over the heat releasing coil and into the space to be heated. Each gas burner assembly 12 and 12' is also fluidly connected with a burner vent blower unit 22 which forces combustion air past the gas burner assemblies 12 and 12' and the heat absorbing coil. A suitable air blower motor is Dayton model No. 4C564.

A source of 110 or 120 volt electric power is provided across a "hot" line or power line 32 and a neutral line 30. Power line 32 includes a power switch 34 and a fuse 36 which contains a 15 ampere time delay fuse. Lines 30 and 32 are connected to a control voltage transformer 38 which produces a 24 volt output. The 24 volt output of control voltage transformer 38 is electrically connected to pressure safety control unit 40 through a 4 ampere fuse 42. In the preferred embodiment of the heating system, a diaphragm pressurized expansion tank is provided in the hydronic fluid circulation loop to maintain the pressure in the hydronic fluid at approximately 10 psi. In case a leak develops in the hydronic fluid loop, pressure safety control unit 40 is set to electrically disconnected from control voltage transformer 38, i.e., shorted out by a normally open switch 40*a*, when the pressure drops below 5 psi. A suitable pressure safety control unit 40 is Honeywell Model No. L604A-1177.

Connected in series with pressure safety control unit 40 is a thermostat 44 which is located in the space to be heated. Thermostat 44 is also connected to a first relay 46 and a normally closed burner temperature limit control switch 48. Burner temperature limit control switch 48 is closed and thus electrically connected to thermostat 44 so long as the temperature in gas burner assemblies 12 and 12' do not exceed a predetermined temperature. A suitable burner temperature limit control switch 48 is Dayton Model No. 2E146. Relay 46 includes a relay coil 46*a* which operates dpst switch contacts 46*b* and 46*c* described below. Burner temperature limit control switch 48 is connected in series with the normally closed contacts 52*a* of a time delay relay switch unit 52. A suitable form of time delay switch unit is an adjustable solid-state plug-in time delay relay Dayton Model No. 5X829.

Switching of relay contacts 52*a* is controlled by the relay coil 52*b* of unit 52 which is, in turn, connected to the normally closed switch 66*a* of a burner vent air switch unit 66. Unit 66, which may be a Dayton Model No. 2E462 is connected to an air tube 66*a* which senses the air movement provided by the vent motor of vent blower 22. If the vent motor fails to run, switch 66*b* remains closed and after a predetermined delay provided by delay unit 52, normally closed relay switch 52*a* will be opened and the system shut down. The normally closed contacts 52*a* of time delay switch unit 52 are electrically connected to a pair of combustion safety control units 54 and 54' through a service test switch 56. A combustion safety control circuit suitable for use as units 54 and 54' is Honeywell solid-state Module No. S8250.

Combustion safety control units 54 and 54' are electrically connected to ignitors 16 and 16' and to a pair of flame sensors 58 and 58', respectively. A suitable flame sensor is a Honeywell flame sensor No. Q354A which produces a 4-10 micro ampere signal in response to a flame in the gas burner assembly of appropriate intensity. As shown, combustion safety control unit 54 is electrically connected to main gas valve 14; and the main gas valve 14, combustion safety control units 54 and 54', and the other side of the 24 volt output of control voltage transformer 38 are all connected to a common ground line 60.

Connected to power feed line 32 is a time delay relay unit 62. Time delay relay unit 62 is similar to time delay relay unit 52, although the former is adjusted to have a shorter time delay than the latter. Time delay relay unit 62 includes a normally open switch 62*a* electrically connected to an adjustable speed control unit 64 which, in turn, is electrically connected to burner vent blower 22 so as to control the speed of burner vent blower 22. A neutral terminal of burner vent blower 22 is connected to neutral line 30. Time delay relay unit 62 includes a coil 62*b* connected in series between the normally open contacts 50 of relay 46 and the coil 52*b* of relay unit 52. As shown, circulating pump 18 is electrically connected to first relay unit 46 and, through connection X1, to a first set of normally open contacts 68*b* of a second relay unit 68.

Air blower 20 is electrically connected to a second set of normally open contacts 68*c* of second relay unit 68. A hydronic fluid temperature sensor 70 is electrically connected to the control coil 68*a* of second relay unit 68. Hydronic fluid temperature sensor 70 provides a signal in response to the exceeding of a minimum temperature of the hydronic fluid. A suitable sensor is Dayton Model No. 2E146.

In operation, the control circuit shown in the drawing functions in the following manner to heat a space with the heating system. Ordinarily, the operation of the control circuit is initiated by thermostat 44 so that lines 30 and 32 are normally connected to a suitable source of electric power with power switch 34 closed. Assuming that the hydronic pressure is above 5 psi so that pressure safety control unit 40 is electrically connected to thermostat 44, thermostat 44 is closed when heat is needed in the space to be heated. In response to the closing of the thermostat 44, a first electrical circuit is completed through the control coil 46*a* of first relay unit 46 and a second electrical circuit is completed through burner temperature limit control unit 48. As soon as the thermostat switch 44 is closed, coil 46*a* of first relay unit 46 closes the normally opened contacts 46*b*, 46*c* so as to cause circulating pump 18 to pump the hydronic fluid from the heat absorbing coils to the heat releasing coils and back again. First relay unit 46 also initiates the timing out of the delays provided by time delay relay 62 and time delay relay 52, the coil 52*a* of the latter being energized through normally closed burner vent air switch 66*b*. Closing of thermostat switch 44 also provides for energization of combustion safety control units 54, 54' through the normally closed contacts of temperature limit control unit 48, the normally closed switch 52*a* of relay 52, and switch 56, which is closed at this time. The circuit will be complete as long as the temperature in gas burner assemblies 12 and 12' do not normally exceed the burner temperature limit so that the contacts of burner temperature limit control unit 48 remains closed. When energized, combustion safety control units 54 and 54' immediately supply an electrode ignition voltage of 25,000 volts to ignitors 16 and 16', respectively, and also immediately open main gas supply valve 14. When the gas burners ignite and combustion is established, flame sensor means 58 and 58' transmit a signal of 4 to 10 micro amperes to the respective combustion safety control units 54 and 54'. If this signal is within the specified limits, main gas valve 14 remains open. It should be noted that if either flame sensor means 58 or 58' ceases to generate a suitable signal, main gas valve 14 immediately closes.

After a time delay of approximately 8 to 10 seconds provided by time delay relay 62, the normally open contact 62*a* closes and burner vent blower 22 is energized through adjustable speed control unit 64. During this 8 to 10 second delay, the combustion of the gas in gas burner assemblies 12 and 12' is sufficiently established so that the combustion air supplied by burner vent blower 22 does not extinguish the flame. As burner vent blower 22 commences operation, the normally closed switch 66*b* of burner vent air switching unit 66 opens and de-energizes relay 52*b* so as to terminate the timing period of time delay relay 52. By adjusting time delay relay 52 to provide a time delay of up to 12 to 14 seconds, i.e., a period longer than the time delay of time delay relay 62, the normally closed switch 52*a* of time delay relay 52 remains closed because burner vent air switch means 66*b* opens and de-energizes relay coil 52*b* and terminates the timing out of relay unit 52.

When the temperature of the hydronic fluid circulating between the two heating coils is sufficient to supply heat to the space to be heated, hydronic fluid temperature sensor 70 completes the circuit including relay coil 68*a* of the second relay switch unit 68. This causes the two sets of contacts 68*b* and 68*c* of second relay switch unit 68 to close. Closing of contacts 68*c* provides energization of air blower 20 so that air blower 20 commences to force air over the heat releasing coil and into the space to be heated. The other set of contacts 68*b* provides energization of circulating pump 18, which at this time is already operating. After the space to be heated has been heated sufficiently, thermostat switch 44 opens to open the circuit including combustion safety control units 54 and 54' and the relay coil 46*a* of first relay switch unit 46. Thus, main gas valve 14 is immediately closed and gas burner assemblies 12 and 12' are shut off. At the same time, the contacts 46*b* and 46*c* of first relay switch unit 46 open thereby causing de-energization of the coil of time delay relay 62 and opening of switch 62*a* so to to disconnect burner vent blower 22. Opening of contacts 46*b* of first relay switch unit 46 provides for disconnection of circulating pump 18. However, as the temperature of the hydronic fluid is still sufficient to supply heat to the space to be heated, the hydronic fluid temperature sensor 70 continues to complete the circuit including coil 68*a* of the second relay switch unit 68. Under this circumstance, air blower 20 and circulating pump 18 continue to operate and supply heat to the space to be heated so long as the temperature of the hydronic fluid is sufficient. When the temperature of the hydronic fluid falls sufficiently so that little heat can be recovered from the hydronic fluid, hydronic fluid temperature sensor 70 provides disconnection of second relay switch unit 68 to shut off circulating pump 18 and air blower 20. At this time, the control circuit is ready to repeat the cycle again as needed.

It should be appreciated that there are a number of safety features in the control circuit of the invention. For example, if the hydronic fluid should leak from the circulating loop, pressure safety control unit 40 senses the drop from the correct pressure level, switch 40*a* opens, and the system is disconnected from transformer 38. In addition, if the temperature in gas burner assembly 12 or 12' should exceed a safe operating temperature, burner temperature limit control unit 48 opens and electrically disconnects both combustion safety control units 54 and 54' causing main gas valve 14 to close and gas burner assemblies 12 and 12' to shut down. Each gas burner assembly 12 and 12' also has a respective flame sensor 58 and 58' and if main gas valve 14 is opened and a flame is not sensed in both gas burner assembly 12 or 12' by flame sensors 58 and 58', the absence of a signal from flame sensors means 58 and 58' causes main gas valve 14 to close.

Burner vent air switch unit 66 also provides a safety feature which insures that burner vent blower 22 is operating. As discussed above, when burner vent blower 22 commences operation after a time period determined by time delay relay unit 62 to allow for combustion to be established in gas burner assemblies 12 and 12', the effect of opening of switch 66*b* of burner vent air switch unit 66 is delayed by time delay relay 52 which provides a delay longer than the time delay of time delay relay 62. With this arrangement, the relay switch 52*a* does not open until after the time at which burner vent blower 22 should have begun operation and thus have already caused opening of burner vent air switch 66*b*. If burner vent air switch 66*b* does not open during this period, time delay relay unit 52 causes the normally closed switch 52*a* to open and thus electrically disconnect combustion safety control units 54 and 54'.

It will be appreciated that any power failure also causes main gas valve 14 to close as a signal is no longer received from combustion safety control units 54 and 54'. Each time that combustion safety control units 54 and 54' and time delay relays 52 and 62 are electrically disconnected, this resets the devices so that they are ready to commence operation again as necessary. As an added safety precaution during servicing, service test switch 56 is open to electrically disconnect combustion safety control units 54 and 54' while any maintenance is performed adjacent gas burner assemblies 12 and 12'.

While the preferred embodiment of the present invention has been described with reference to specific elements and their operation, it should be appreciated that a variety of different elements may be substituted for the specified elements. For example, while ignitor 16 and 16' have been described as electronic ignitors, a pilot light could be successfully substituted therefor. It would also be possible to substitute other switching devices for first and second relays 46 and 68. Likewise, time delay relays 52 and 62 could also be replaced with equivalent devices.

Thus while the invention has been described in detail with respect to an exemplary embodiment thereof, it will be understood by those of ordinary skill in the art that these and other variations and modifications may be effected in the exemplary embodiment within the scope and spirit of the invention.

I claim:

1. A control circuit for a heating system having a compartment in which a gas burner assembly and a heat absorbing coil are disposed, the burner assembly including an ignitor and a main gas valve, the heating system further having a heat releasing coil disposed in an enclosure in a space to be heated, a circulating pump means for pumping a hydronic fluid between the two coils, and an air blower means for blowing air over the heat releasing coil and into the space to be heated; said control circuit comprising:

a thermostat means located in the space to be heated for supplying an electrical signal in response to the need for heat in the space to be heated;

a first switch means for energizing the circulating pump means in response to a signal from said thermostat means;

a flame sensor means located in the gas burner assembly for providing a signal in response to the presence of a flame;

a combustion safety control means electrically connected to said thermostat means, the main gas valve, and said flame sensor means for supplying a signal to open the main gas valve in response to the signal from the thermostat means, and for supplying a signal to close the main gas valve when a signal of less than a selected level is received from said flame sensor or no signal is received from said thermostat means;

a hydronic fluid temperature sensor means for producing an electrical signal in response to the hydronic fluid exceeding a minimum temperature level;

a second switch means for energizing the air blower means and the circulating pump means in response to the signal from said hydronic fluid temperature sensor means such that, after the signal from said thermostat means ceases and said first switch means no longer provides energization of the circulating pump means, said second switch means continues to provide energization to the circulating pump means and the air blower means so long as a signal is received from said fluid temperature sensor means.

2. A control circuit as claimed in claim 1 wherein the ignitor is electrically controlled and said combustion safety control means also supplies a signal to the ignitor in response to the signal from said thermostat means.

3. A control circuit as claimed in claim 1 further including a burner temperature limit control means which is electrically connected in series with said thermostat means and said combustion safety control means for supplying a signal to said combustion safety control means when the temperature in the gas burner assembly is below a specified temperature, said burner temperature limit control means being disconnected from said combustion safety control means when the temperature within the gas burner assembly exceeds the specified temperature such that the main valve immediately closes.

4. A control circuit as claimed in claim 1 further including a pressure safety control means electrically connected in series with said thermostat means for supplying a signal when the pressure of the hydronic fluid is above a specified pressure, said pressure safety control means being disconnected when the pressure of the hydronic fluid falls below the specified pressure such that the main gas valve immediately closes.

5. A control circuit as claimed in any one of claims 1, 3 or 4 for a heating system also having a burner vent blower means which forces combustion air past the gas burner assembly and the heat absorbing coil, wherein said first switch means also electrically connects the burner vent blower means in respone to a signal from said thermostat means.

6. A control circuit as claimed in claim 5 further including a first time delay switch means electrically connected in series with the burner vent blower means for delaying the activation of the burner vent blower means for a time period during which the operation of the gas burner assembly is fully established.

7. A control circuit as claimed in claim 6 further including an adjustable speed control means electrically connected in series with the burner vent blower means for controlling the amount of combustion air delivered by the burner vent blower means to the gas burner assembly.

8. A control circuit as claimed in claim 7 further including a burner vent air switch means for sensing the movement of air as a result of the operation of the burner vent blower means and for producing a signal in response to the absence of any air flow, said air switch means being electrically connected to said first switch means; and a second time delay switch means electrically connected in series with said thermostat means and said combustion safety control means for receiving the signal from said air switch means and electrically disconnecting said combustion safety control means after the signal from said air switch means is continuously received for a time period which is longer than the time period of said first time delay means.

9. A control circuit as claimed in claim 8 for a heating system having a plurality of gas burner assemblies, said control circuit further including a combustion safety control means and a flame sensor means for each gas burner assembly, each said combustion safety control means being electrically connected to said thermostat means and to the main gas valve such that when any one of the flame sensors fails to provide a sufficient signal to said corresponding safety control means, the main gas valve closes.

10. A control circuit as claimed in claim 9 further including a test switch electrically connected to said combustion safety control means which is adapted to be opened to electrically disconnect said gas burner assemblies when servicing is performed on said gas burner assemblies.

* * * * *